US005902970A

United States Patent [19]

Ferri

[11] Patent Number: 5,902,970

[45] Date of Patent: May 11, 1999

[54] MUFFLER FOR INTERNAL COMBUSTION ENGINES, ESPECIALLY IN AVIATION OF IMPROVED GEOMETRY AND MATERIAL

[76] Inventor: Alain Ferri, 1, rue Simonetti Baux Roux, F0660 Sasint-Martin-du-Var, France

[21] Appl. No.: 08/809,951

[22] PCT Filed: Jul. 16, 1996

[86] PCT No.: PCT/FR96/01098

§ 371 Date: Apr. 17, 1997

§ 102(e) Date: Apr. 17, 1997

[87] PCT Pub. No.: WO97/04220

PCT Pub. Date: Feb. 6, 1997

[30] Foreign Application Priority Data

Jul. 17, 1995 [FR] France ..... 95 08838

[51] Int. Cl.[6] ..... F01N 1/02

[52] U.S. Cl. ..... 181/249; 181/252; 181/272

[58] Field of Search ..... 181/227, 228, 181/249, 251, 252, 255, 256, 258, 257, 269, 272, 282

[56] References Cited

U.S. PATENT DOCUMENTS

| | | | |
|---|---|---|---|
| 1,611,475 | 12/1926 | Maxim . | |
| 1,844,105 | 2/1932 | Schnell | 181/252 |
| 2,943,695 | 7/1960 | Feffords | 181/252 |
| 3,685,614 | 8/1972 | Coanda et al. | 181/252 |
| 4,282,950 | 8/1981 | Fuchs | 181/257 |
| 4,360,076 | 11/1982 | Suyama | 181/269 |
| 4,632,216 | 12/1986 | Wagner . | |
| 4,690,245 | 9/1987 | Gregorich et al. | 181/249 |
| 5,280,143 | 1/1994 | Kakuta . | |

FOREIGN PATENT DOCUMENTS

| | | |
|---|---|---|
| 1041034 | 10/1953 | France . |
| 2467974 | 4/1981 | France . |
| 4122014 | 5/1992 | Germany . |
| 9215816 | 1/1993 | Germany . |
| 274724 | 7/1951 | Switzerland . |
| 449507 | 6/1936 | United Kingdom . |
| 986576 | 3/1965 | United Kingdom . |
| 2016085 | 9/1979 | United Kingdom . |

OTHER PUBLICATIONS

Patent Abstracts of Japan, vol. 17, No. 558, Oct. 7, 1993; JPA 05 156935 (Mazda Motor Corp), Jun. 22, 1993.

Database WPI week 9540, Derwent publications Ltd. AN 95–310017, JP–A–07 208 145 (Tsunoda), Aug. 8, 1995.

WO A 85 04688 (Young) Oct. 24, 1985.

*Primary Examiner*—Khanh Dang

*Attorney, Agent, or Firm*—Bierman, Muserlian and Lucas

[57] ABSTRACT

A muffler device for the exhaust of an internal combustion engine comprising a tube (1) formed of at least a cone and a cylinder of a single piece of perforated sheet metal with alternating holes of varying diameters distributed over its length, the tube (1) being surrounded with a coaxial envelope formed of a cylindrical and/or conical front portion (2) and a back portion (3) with a conical nozzle terminating in an exhaust pipe at an angle to permit exhaustion of gas, the exhaust gases passing through an annular space between the tube and envelope through outlet parts or walls whose form and geometry prevent the formation of a turbulence generating back pressure.

8 Claims, 4 Drawing Sheets

MUFFLER FOR INTERNAL COMBUSTION ENGINES, ESPECIALLY IN AVIATION OF IMPROVED GEOMETRY AND MATERIAL

The present invention relates to an exhaust muffler for internal combustion engines, especially for aircraft.

BACKGROUND OF THE INVENTION

There are presently several baffle plate muffler systems, by absorption by expansion, which permit attenuating the level of noise emitted to bring into compliance with the standards in force. These systems have the disadvantages of causing overheating and turbine blade counter pressures.

SUMMARY OF THE INVENTION

To alleviate these disadvantages the invention proposes a simple device using a particular geometry, and secondarily, components of austenite stainless steel. Besides the substantial reduction of the level of noise emitted in comparison with the existing systems, as will be described in an application example later, the proposed device is easy to install and to remove; its maintenance is easy and its durability over time is improved.

It was not obvious that the proposed geometry and the selection of an austenite stainless steel would permit obtaining the important advantages of the invention, and especially a gain greater than 5 dB minimum compared to mufflers of the former type. Nor was it obvious that baffle plate devices should be rejected, which are used often in numerous types of mufflers, in various types of industries.

Briefly, the muffler according to the invention, according to a preferred but not limiting mode of implementation, comprises a perforated tube extending throughout its length, and this muffler is characterized by the fact that the tube forms a geometry with several cones whose function is that of forming a substantial volume, of creating at least one system known under the term "venturi" to accelerate the flow of exhaust gas by the fact that the gas passing in the annular space between the tube and the envelope and escaping by the outlet parts whose shape and geometry prevent the formation of turbulence generating back pressures. Secondarily, according to a preferred mode of implementation, the muffler is made of austenite stainless steel. The space between the tube and the envelope is filled with steel wool likewise of austenite stainless steel.

An important advantage of the invention is that it permits the treatment of a more substantial volume of gas with a greater contact surface, the unit reducing the noise in a very significant degree, while permitting, which is surprising, the rapid exhaust of this greater volume without generating the major disadvantage which can be anticipated, of back pressure.

The geometry of the invention will be understood by a specialist in the field upon reading the enclosed drawings, without it being necessary to explain it in greater detail. A specialist in the field will moreover be able to imagine without difficulty the variants and derivatives of this geometry, observing the above general concept.

It is likewise surprising to note that the disagreeable noise well known to professionals using stainless steel (caused by ultrasonic frequencies) is not produced by the device according to the invention. It is known, for example, that the use of copper gives a "felt" sound but copper is naturally heavier. It is surprising to obtain an agreeable sound with a material sought for its qualities but likewise notorious for its disagreeable sound.

Other features and advantages of the invention will be clearly evident in the following description given by way of non-limiting example in regard to the enclosed figures, in which represent:

DETAILED DESCRIPTION OF THE INVENTION

Figure 1:
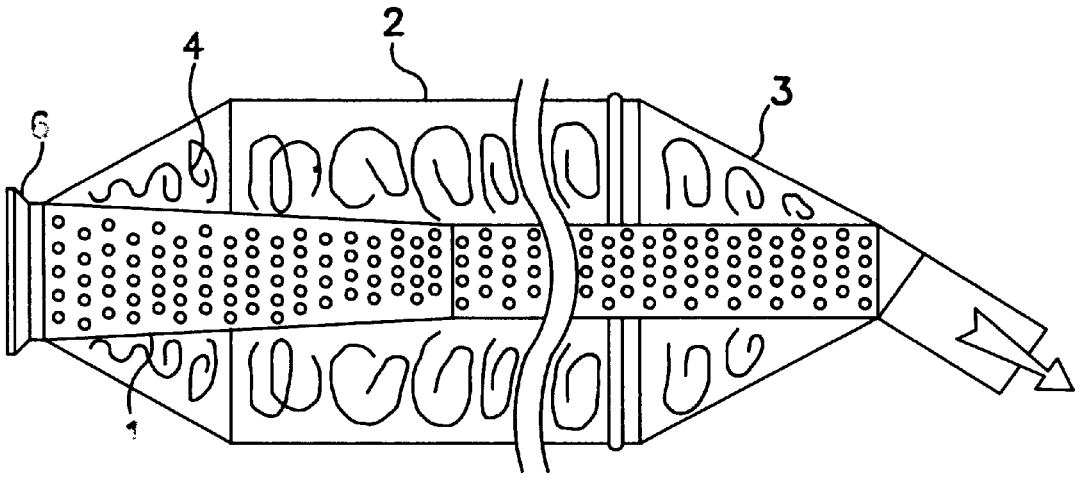
FIG. 1: a longitudinal cutaway view of the device according to the invention.

In reference to FIG. 1, the device comprises a tube (1) formed of a cone and of a cylinder of a single piece of perforated sheet metal, alternating holes of different diameter from one row to another, throughout the length of the muffler. The outside envelope is formed of a front part (2) which is cylindrical and conical, and a conical end (3) forming the back part and ending by an exhaust tube at an angle permitting exhaust of the gas downwardly. The front part of the outside envelope (2) is conical here to facilitate penetration into the air. The edges of these two parts (2) and (3) intended to be assembled are machined by crimping to form two circular throats according to a known technique. According to a preferred characteristic of the invention, the three components (1), (2), and (3) are of austenite stainless steel (it will be recalled that austenite is a component of steel comprised of a solid solution of iron and carbon) as well as the steel wool packing (4).

The assembly of the muffler is carried out in the following way:

Welding of the pipe on the front part at the level of the neck (6).

Filling the space between the pipe and the envelope with austenite stainless steel wool (4).

Putting in place a back end (3) by insertion and screwing on.

The number and the size of the tube's perforations are adapted as a function of the engine displacement. The muffler is connected to the exhaust pipe by an expansion bellows member which is itself held by two collars with set screws.

Figure 2:
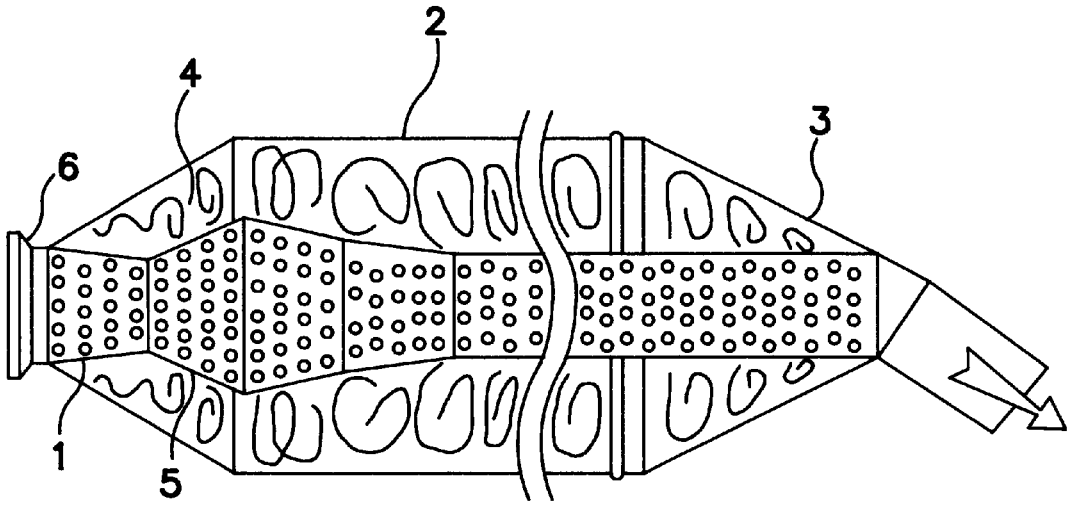
FIG. 2: a longitudinal cutaway view of a variant of the device according to the invention.

FIG. 2 represents a variant of the device in which the tube comprises various counter cones (5) designed according to the applications to improve the pressure reduction of the gases in the steel wool (4).

Figure 7:
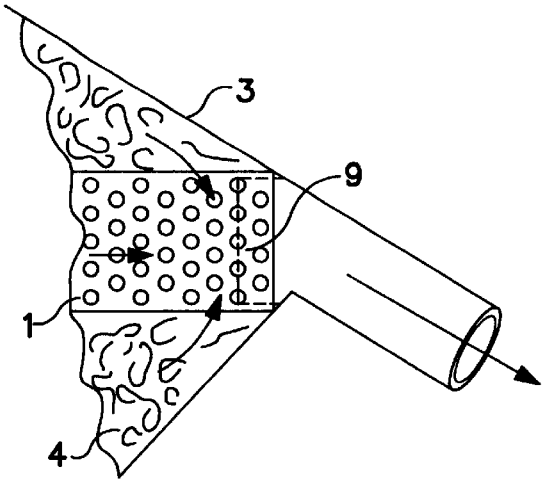
FIG. 7: detail of a device represented in FIG. 1 or 2, FIGS. 8 and 9: details of a device represented in FIG. 3 or 4.

FIG. 7 represents a back part of a device described in FIG. 1 or 2, in which is represented the fitting (9) of the conical end (3) on the tube (4).

Figure 3:
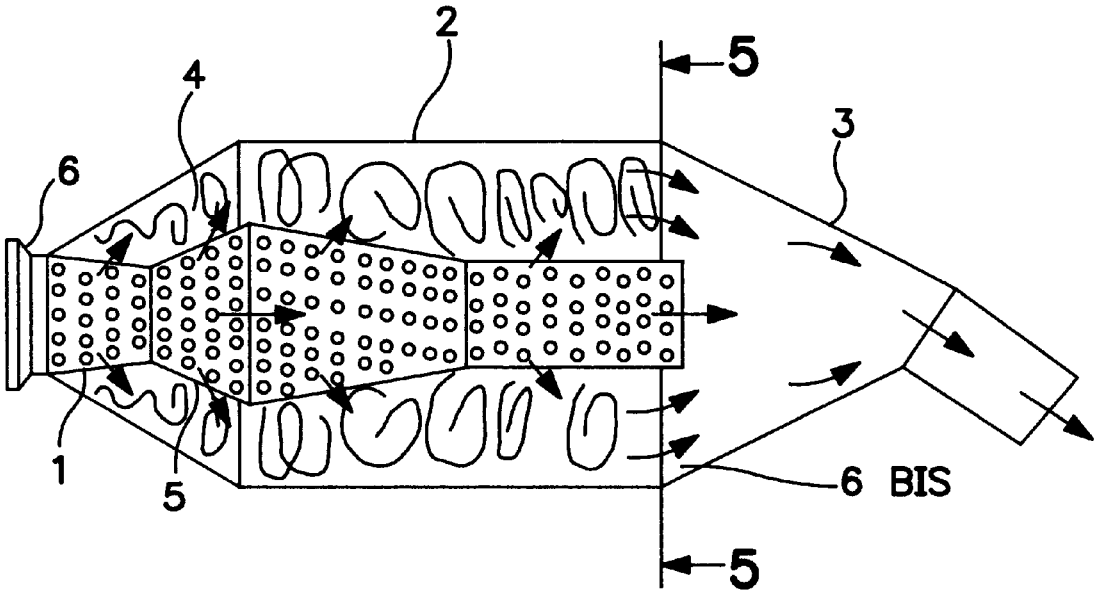
FIGS. 3 and 4: longitudinal cutaway views of variants of the device according to the invention.
Figure 5:
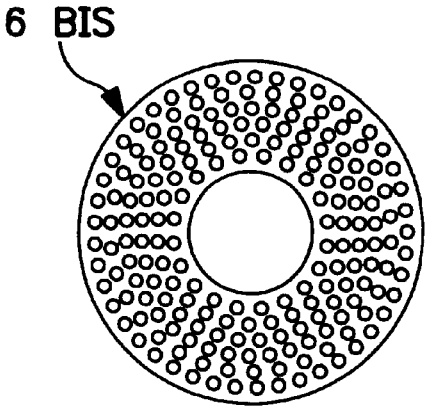
FIGS. 5 and 6: respective transverse views of FIGS. 3 and 4 along A—A (representing the perforated partitions (6*a*)
Figure 4:
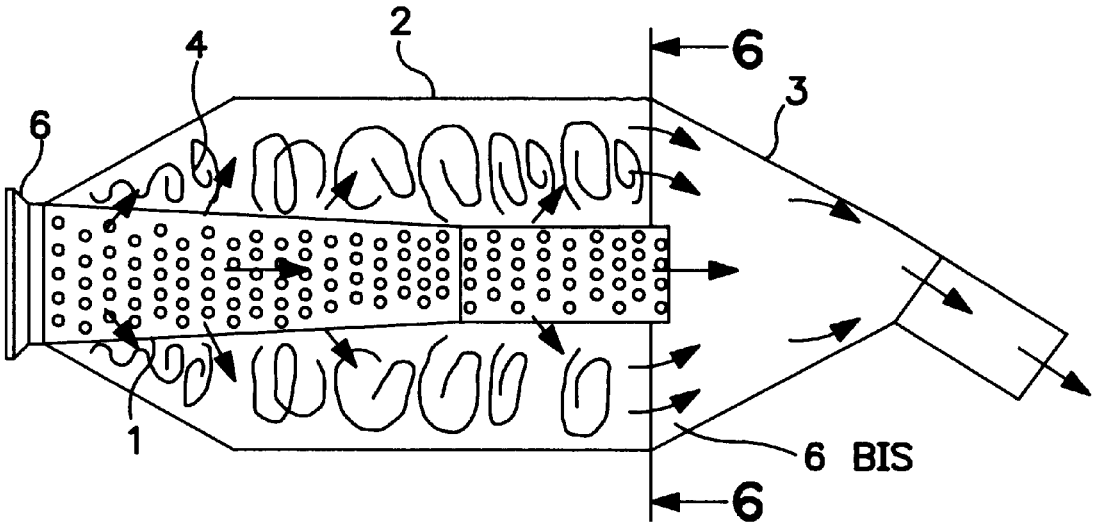
Figure 6:
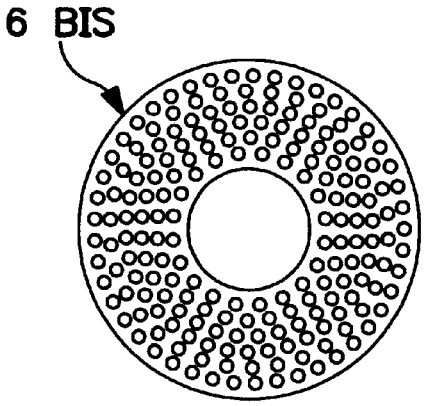

FIGS. 3 and 4 represent further variants of the device according to the invention.

In these variants, a perforated internal partitioning (6*a*) in the shape of a disk is placed perpendicular to the axis of the tube to keep the stainless steel wool in place and above all to facilitate the exhaust of the gases, hence the result of a reduction in the back pressure. The steel wool is preferably kept at the back part by this perforated internal partitioning or plate (6*a*) providing passage of the gases to its periphery and at its center, to the outlet of the tube.

In these variants, the tube is welded on the back perforated partition (6*a*) which itself is screwed on the back part of the outside envelope (2) and the conical end (3) and inserted on the front part of the outside envelope (2) at the neck (6).

Figure 8:
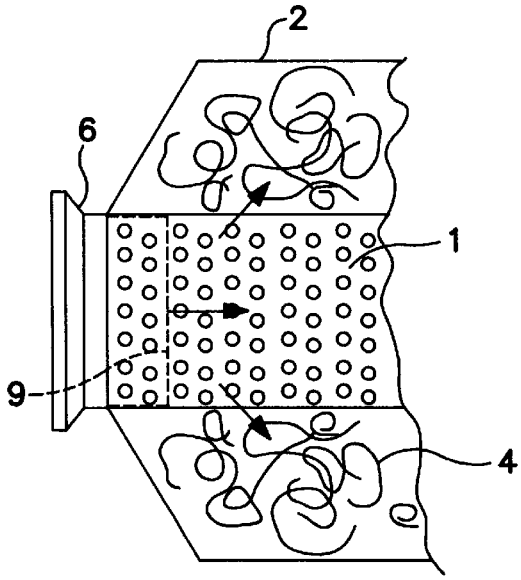

FIG. 8 represents the front part of a device described in FIG. 3 or 4 in which is represented the fitting (9) of the pipe (1) onto the outside envelope (2) at the neck (6).

Figure 9:
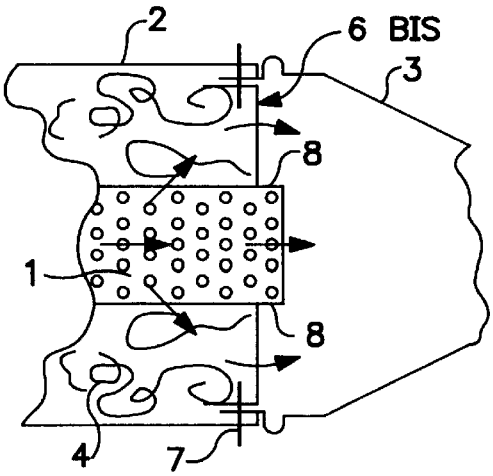

FIG. 9 represents the back part of a device described in FIG. 3 or 4 in which is represented the welding (8) of the pipe (1) on the perforated partition (6*a*) and the screwing (7) of the outside envelope (2), the conical end (3) and the perforated partition (6*a*).

EMBODIMENT EXAMPLE

According to one example, a muffler is produced as described here with a tube 1⁄10ths thick and an envelope of 8⁄10ths thickness. The perforations have diameters varying between 8 and 10 mm. The test prototype furnished the following results:

Benchmark: maximum power for a posted speed of 2350 rpm: 64 dB.

Release of brakes—2500 rpm for a posted speed upon release of 2300 rpm: 74 dB.

Stabilized 300 feet passage—2500 rpm: 73 dB.

Stabilized 1000 feet passage—2500 rpm: 67 dB.

Speed upon pulling nose up for a rolling time obtained in 20 seconds: 71 dB.

Stabilized 300 feet passage—2500 rpm for posted speed upon passage of 120 knots: 70 dB.

Stabilized 1000 feet passage—2500 rpm for posted speed upon passage of 112 knots: 68 dB.

Initial climb of 80 knots for a posted speed of 2500 rpm: 70 dB.

Stabilized 300 feet passage—2500 rpm: 70 dB.

Stabilized 1000 feet passage—2500 rpm: 65 dB.

80 knots initial vertical climb for a height obtained upon passage of 500 feet: 89 dB.

Stabilized 300 feet passage—2500 rpm: 87 dB.

Stabilized 1000 feet passage—2500 rpm: 78 dB.

On the average, the level was equal to 72.8 dB.

By way of comparison, the same measurements obtained with a conventional muffler are the following:

Benchmark: maximum power for a posted speed of 2350 rpm: 77 dB.

Brake release—2500 rpm for a posted speed upon release of 2300 rpm: 74 dB.

Stabilized 300 feet passage—2500 rpm: 80 dB.

Stabilized 1000 feet passage—2500 rpm: 71 dB.

Speed upon climbing 60 knots for rolling time obtained in 20 seconds: 73 dB

Stabilized 300 feet passage—2500 rpm for posted speed upon passage of 120 knots: 75 dB.

Stabilized 1000 feet passage—2500 rpm for posted speed upon passage of 112 knots: 73 dB.

80 knots initial vertical climb for a posted speed of 2500 rpm: 77 dB

Stabilized 300 feet passage—2500 rpm: 73 dB.

Stabilized 1000 feet passage—2500 rpm: 70 dB.

80 knots initial vertical climb for a height obtained on passage of 500 feet: 92 dB.

Stabilized 300 feet passage—2500 rpm: 96 dB.

Stabilized 1000 feet passage—2500 rpm: 86 dB.

On the average, the level was equal to 78.2 dB.

Notes: kn=knots. 1 foot is about equal to 33 cm.

The device according to the invention makes it possible to obtain today a gain greater than 5 dB in comparison with present conventional mufflers. This device is especially intended to equip aircraft with an engine displacement of 4000 to 8000 square meters [sic] and more particularly the Piper PA 28.

Other modes of implementation will be readily apparent to the specialist in the field and are a part of the invention. In particular, the form and dimension of the components may be adapted on the condition that the general concept of the invention is observed, i.e. the choice of shapes creating at least one venturi to accelerate the gases in at least one part of their travel path, and the shapes generating the least possible turbulence at the outlet of the venturi. In particular, the cones may be "rounded" and the venturi replaced by an accelerator device of the same function. The only limits in this domain will be the cost and the requirements of installation and maintenance. Likewise, the steel wool (4) may be replaced by any material of a structure performing an equivalent function. Finally, the austenite stainless steel may be replaced by any material capable of performing the same function.

What is claimed is:

1. A muffler device for the exhaust of an internal combustion engine comprising a tube (1) formed of at least a cone and a cylinder of a single piece of perforated sheet metal with alternating holes of varying diameters distributed over its length, the tube (1) being surrounded with a coaxial envelope formed of a cylindrical and/or conical front portion (2) and a back portion (3) with a conical nozzle terminating in an exhaust pipe at an angle to permit exhaustion of gas, the exhaust gases passing through an annular space between the tube and envelope through outlet parts or walls whose form and geometry prevent the formation of a turbulence generating back pressure.

2. A muffler device for the exhaust from an internal combustion engine of claim 1, without baffle plates, the tube-envelope unit is made of austenite stainless steel, and the space between the tube and the envelope is filled with a steel wool (4) made of austenite stainless steel, at the back portion by a perforated partition or plate (6*a*) releasing passage of the gas at its periphery and, at its center, to the tube's outlet.

3. A device according to claim 1 wherein the tube is formed of at least one cone, counter-cones (5) and a cylinder, all in one piece.

4. A device according to claim 1 wherein the tube's perforations are comprised of alternating holes of different diameters from one row to another, according to the displacement of the internal combustion engine.

5. A device of claim 1 wherein the envelope is formed of a front part welded to the tube at its neck (6), of a non-movable conical back part, the two edges joining these parts being crimped into two throats to permit rapid disassembly and reassembly.

6. A device of claim 1 wherein the tube is inserted into the outside envelope in front (2) at the neck (6) and welded on the perforated partition (6*a*), itself being screwed onto the outside envelope (2) and the conical end (3).

7. A device of claim 1 wherein mounted on an exhaust of an internal combustion engine, to eliminate overheating and counter turbine blade perturbing pressure whereby the attenuation of the level of noise emitted is greater than 5 dB.

8. A muffler device for the exhaust of an internal combustion engine comprising a tube (1) formed of at least a cone and a cylinder of a single piece of perforated sheet metal with alternating holes of varying diameters distributed over its length, the tube (1) being surrounded with a coaxial envelope formed of a cylindrical and/or conical front portion (2) and a back portion (3) with a conical nozzle terminating in an exhaust pipe at an angle to permit exhaustion of gas, the exhaust gases passing through an annular space between the tube and envelope through outlet parts or walls whose form and geometry prevent the formation of a turbulence generating back pressure in cooperation with the varying diameters of the said alternating holes.

* * * * *